US009163351B2

(12) United States Patent
Kim et al.

(10) Patent No.: US 9,163,351 B2
(45) Date of Patent: Oct. 20, 2015

(54) HEAT PUMP MODULE AND LAUNDRY TREATMENT DEVICE USING THE SAME

(75) Inventors: Na Eun Kim, Seoul (KR); Dong Won Kim, Seoul (KR); Hea Kyung Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1386 days.

(21) Appl. No.: 12/716,434

(22) Filed: Mar. 3, 2010

(65) Prior Publication Data

US 2010/0223960 A1 Sep. 9, 2010

(30) Foreign Application Priority Data

Mar. 3, 2009 (KR) ..... 10-2009-0017942

(51) Int. Cl.
*D06F 25/00* (2006.01)
*D06F 58/22* (2006.01)
*D06F 39/10* (2006.01)

(52) U.S. Cl.
CPC ..... *D06F 58/22* (2013.01); *D06F 25/00* (2013.01); *D06F 39/10* (2013.01)

(58) Field of Classification Search
CPC ..... D06F 58/22; D06F 39/10; D06F 25/00
USPC ..... 34/300, 480, 42; 68/20, 18 F, 5 R
See application file for complete search history.

(56) References Cited

U.S. PATENT DOCUMENTS 2,334,025 A 11/1943 O'Neill
2,351,429 A 6/1944 Huebsch
2,566,488 A 9/1951 Gould
2,644,246 A * 7/1953 Robinson ..... 34/572
2,677,897 A 5/1954 Herbster
2,755,072 A 7/1956 Kreuttner
2,830,385 A 4/1958 Smith
2,943,473 A 7/1960 Worst (Continued)

FOREIGN PATENT DOCUMENTS

CN 1542208 A 11/2004
CN 2680709 2/2005

(Continued)

OTHER PUBLICATIONS

Chinese Office Action dated Aug. 13, 2012 (5041.X) with translation.
Chinese Office Action dated Aug. 13, 2012 (4986.X) with translation.
Chinese Office Action dated Aug. 14, 2012 (5040.5) with translation.
Chinese Office Action dated Aug. 28, 2012 (5042.4) with translation.
U.S. Office Action issued in U.S. Appl. No. 12/709,816 dated Oct. 22, 2012.

(Continued)

*Primary Examiner* — Michael Barr
*Assistant Examiner* — Kevin G Lee
(74) *Attorney, Agent, or Firm* — Ked & Associates LLP

(57) ABSTRACT

A laundry treatment device is provided. The laundry treatment device includes a dual filter structure which may prevent heat transfer efficiency of a heat pump module from becoming poor due to introduction of lint to an inlet duct. The laundry treatment device may include a cabinet, which may form an exterior of the laundry treatment device, a tub mounted in the cabinet configured to accommodate washing water therein, a drum rotatably mounted in the tub configured to receive laundry therein, a heat pump module mounted under the tub that supplies hot air to the drum and having an inlet duct that receives air from the drum and an outlet duct that discharges the heated air, and a filter module mounted to be accessible through a lower side of a front of the cabinet that filters air received therethrough.

31 Claims, 9 Drawing Sheets

(56) References Cited

U.S. PATENT DOCUMENTS

| | | | | |
|---|---|---|---|---|
| 3,064,358 | A | 11/1962 | Giuffre | |
| 3,636,735 | A | 1/1972 | Borochaner | |
| 4,292,744 | A | 10/1981 | Nabholz | |
| 4,603,489 | A | 8/1986 | Goldberg | |
| 4,621,438 | A | 11/1986 | Lanciaux | |
| 5,097,606 | A * | 3/1992 | Harmelink et al. | 34/467 |
| 5,107,603 | A | 4/1992 | Durazzani | |
| 5,174,467 | A | 12/1992 | Sullivan | |
| 5,343,632 | A | 9/1994 | Dinh | |
| 5,392,613 | A | 2/1995 | Bolton et al. | |
| 5,435,837 | A * | 7/1995 | Lewis et al. | 96/54 |
| 5,640,783 | A | 6/1997 | Schumaier | |
| 5,664,430 | A | 9/1997 | Karman | |
| 5,689,962 | A | 11/1997 | Rafalovich | |
| 5,697,227 | A | 12/1997 | Bruce et al. | |
| 5,732,562 | A | 3/1998 | Moratalla | |
| 5,732,565 | A | 3/1998 | Ramakrishnan et al. | |
| 5,787,721 | A | 8/1998 | Fromm et al. | |
| 5,806,207 | A | 9/1998 | Merrigan | 34/603 |
| 5,901,566 | A | 5/1999 | Macosko et al. | |
| 6,085,539 | A | 7/2000 | Meyer | |
| 6,098,310 | A | 8/2000 | Chen et al. | 34/475 |
| 6,471,739 | B2 | 10/2002 | Eom | |
| 6,701,739 | B2 | 3/2004 | Morse | |
| 6,997,966 | B2 * | 2/2006 | Iantorno | 55/385.1 |
| 7,055,262 | B2 | 6/2006 | Goldberg et al. | |
| 7,165,416 | B2 | 1/2007 | Lee et al. | |
| 7,168,274 | B2 | 1/2007 | Slutsky et al. | |
| 7,174,741 | B2 | 2/2007 | Lee et al. | |
| 7,213,407 | B2 | 5/2007 | Hu | |
| 7,263,852 | B2 | 9/2007 | Bacchus | |
| 7,284,388 | B2 | 10/2007 | Yoshida | |
| 7,325,333 | B2 | 2/2008 | Tadano et al. | |
| 7,409,776 | B2 | 8/2008 | Ono et al. | |
| 7,412,853 | B2 * | 8/2008 | Hong et al. | 68/19.1 |
| 7,418,826 | B2 | 9/2008 | Rios et al. | |
| 7,430,877 | B2 | 10/2008 | Davenport et al. | |
| 7,469,486 | B2 | 12/2008 | Tamura et al. | |
| 7,694,434 | B2 | 4/2010 | Lee | |
| 7,866,061 | B2 | 1/2011 | Tatsumi et al. | |
| 7,908,766 | B2 | 3/2011 | Ahn et al. | |
| 7,950,245 | B2 | 5/2011 | Lee et al. | |
| 7,975,502 | B2 | 7/2011 | Tamura et al. | |
| 7,984,568 | B2 | 7/2011 | Dittmer et al. | |
| 8,037,707 | B2 | 10/2011 | Lee et al. | |
| 8,056,351 | B2 | 11/2011 | Marciano et al. | |
| 8,079,157 | B2 | 12/2011 | Balerdi Azpilicueta et al. | |
| 8,171,748 | B2 | 5/2012 | Ooishi et al. | |
| 2001/0049846 | A1 * | 12/2001 | Guzzi et al. | 8/158 |
| 2004/0079121 | A1 | 4/2004 | Yabuuchi et al. | 68/19.2 |
| 2004/0182100 | A1 | 9/2004 | Lee et al. | |
| 2005/0198851 | A1 | 9/2005 | Tomochika et al. | |
| 2005/0204755 | A1 | 9/2005 | Nishiwaki et al. | |
| 2006/0075790 | A1 * | 4/2006 | Jeon et al. | 68/17 R |
| 2006/0096335 | A1 * | 5/2006 | Park et al. | 68/20 |
| 2006/0191289 | A1 | 8/2006 | Bush et al. | |
| 2006/0218976 | A1 | 10/2006 | Lee et al. | 68/15 |
| 2006/0263501 | A1 | 11/2006 | Oghafua et al. | |
| 2007/0095111 | A1 | 5/2007 | Watkins et al. | |
| 2007/0113574 | A1 | 5/2007 | Davenport et al. | |
| 2007/0134522 | A1 | 6/2007 | Ko et al. | |
| 2007/0220776 | A1 * | 9/2007 | Guinibert et al. | 34/603 |
| 2008/0000253 | A1 | 1/2008 | Kim et al. | |
| 2008/0223084 | A1 | 9/2008 | Kuwabara | |
| 2009/0013730 | A1 | 1/2009 | Woo et al. | |
| 2010/0077787 | A1 | 4/2010 | Masuda et al. | |
| 2010/0107703 | A1 * | 5/2010 | Hisano et al. | 68/20 |
| 2010/0180621 | A1 | 7/2010 | Lee et al. | |
| 2010/0326116 | A1 | 12/2010 | Kwon | |

FOREIGN PATENT DOCUMENTS

| | | | |
|---|---|---|---|
| CN | 1667177 | | 9/2005 |
| CN | 1695029 | | 11/2005 |
| CN | 1966844 | | 5/2007 |
| CN | 101122405 | | 2/2008 |
| CN | 101122410 | | 2/2008 |
| CN | 101135101 | | 3/2008 |
| CN | 101139791 | | 3/2008 |
| CN | 101153456 | | 4/2008 |
| CN | 101173478 | | 5/2008 |
| CN | 101187140 | | 5/2008 |
| CN | 101348989 | | 1/2009 |
| DE | 42 12 700 | A1 | 10/1993 |
| DE | 4212700 | A1 * | 10/1993 |
| EP | 0 943 721 | A1 | 9/1999 |
| EP | 1 634 984 | A1 | 3/2006 |
| EP | 1 726 703 | | 11/2006 |
| GB | 2 289 752 | A | 11/1995 |
| JP | 59-085694 | | 5/1984 |
| JP | 2001-212599 | | 8/1989 |
| JP | 02-029296 | | 1/1990 |
| JP | 05-049795 | | 3/1993 |
| JP | 2001-198398 | | 7/2001 |
| JP | 2004-313493 | | 11/2004 |
| JP | 2005-253589 | A | 9/2005 |
| JP | 2006-110394 | | 4/2006 |
| JP | 2006-320518 | | 11/2006 |
| JP | 2006-345919 | | 12/2006 |
| JP | 2007-111238 | | 5/2007 |
| JP | 2007-127326 | | 5/2007 |
| JP | 2007-143609 | A | 6/2007 |
| JP | 2007-175528 | | 7/2007 |
| JP | 2007-330439 | A | 12/2007 |
| JP | 2007-330571 | | 12/2007 |
| JP | 2008-000226 | A | 1/2008 |
| JP | 2008-006127 | | 1/2008 |
| JP | 2008-48830 | | 3/2008 |
| JP | 2008-104625 | | 5/2008 |
| JP | 2008-253394 | | 10/2008 |
| KR | 10-2001-0095539 | A | 11/2001 |
| KR | 10-2005-0037185 | A | 4/2005 |
| KR | 10-2005-0122468 | | 12/2005 |
| KR | 10-2006-0052284 | | 5/2006 |
| KR | 10-2007-0082377 | | 8/2007 |
| KR | 10-0822153 | B1 | 4/2008 |
| KR | 10-2008-0056007 | | 6/2008 |
| WO | WO 93/12706 | | 7/1993 |
| WO | WO 2005/090669 | | 9/2005 |
| WO | WO 2006/009364 | | 1/2006 |
| WO | WO 2006/097901 | A2 | 9/2006 |
| WO | WO 2006/112611 | | 10/2006 |
| WO | WO 2008/069607 | | 6/2008 |

OTHER PUBLICATIONS

International Search Report and Written Opinion dated Oct. 11, 2010 (Application No. PCT/KR2010/001317).

International Search Report and Written Opinion dated Oct. 19, 2010 (Application No. PCT/KR2010/000713).

International Search Report and Written Opinion dated Apr. 13, 2010 issued in Application No. PCT/KR2010/000487.

U.S. Office Action issued in U.S. Appl. No. 12/700,190 dated Jun. 29, 2012.

U.S. Office Action issued in U.S. Appl. No. 12/700,176 dated Jul. 2, 2012.

European Search Report dated Nov. 16, 2012 issued in Application No. 10 73 8756.

Chinese Office Action dated Nov. 26, 2012 issued in Application No. 201080005766.9 (with English translation).

U.S. Office Action issued in U.S. Appl. No. 12/709,751 dated Apr. 5, 2013.

International Search Report and Written Opinion dated Aug. 2, 2010 issued in Application No. PCT/KR2010/000867.

European Search Report dated Oct. 7, 2014 (2398947).

European Search Report dated Oct. 16, 2014 (2398948).

European Search Report dated Jun. 16, 2015.

* cited by examiner

HEAT PUMP MODULE AND LAUNDRY TREATMENT DEVICE USING THE SAME

This application claims the benefit of the Korean Patent Application No. 10-2009-0017942, filed on Mar. 3, 2009, which is hereby incorporated by reference as if fully set forth herein.

BACKGROUND

1. Field

A heat pump module and a laundry treatment device using the same are disclosed herein.

2. Background

Heat pump modules and laundry treatment devices are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to embodiments, examples of which are illustrated in the accompanying drawings. Wherever possible, the same reference numbers will be used throughout the drawings to refer to the same or like parts.

A basic structure of a laundry treatment device in accordance with embodiments will be described. The laundry treatment device may be, for example, a washing machine.

Recently, use of a washing machine having drying functions, together with a washing function, and having refreshing (removal of crumples or odor from the clothes) function, together with a washing function, or an additional drying function has been increasing. Such a combination washing machine and dryer is often called a laundry treatment device. In general, in the case of a washing and drying machine having a drying function, air may be heated by a heater or a heat pump module, and supplied by a fan to dry laundry.

With related art washing machines, in particular, a washing machine having a heat pump module, lint formed in drying the laundry may be introduced into an inside of a drying duct. Such lint may enter into an evaporator and a condenser, making heat transfer efficiency poor.

Therefore, in order to prevent heat transfer efficiency from being reduced due to the introduction of lint as discussed above, a filtering structure may be provided. Further, the filter should be easy to clean for improvement of a user's convenience.

In the meantime, with dryers, there are condensing type (circulation type) dryers and discharging type dryers. The condensing type dryer requires means for removing condensed water/moisture from humid air formed as the air heat transfers with an object being dried.

Figure 1:
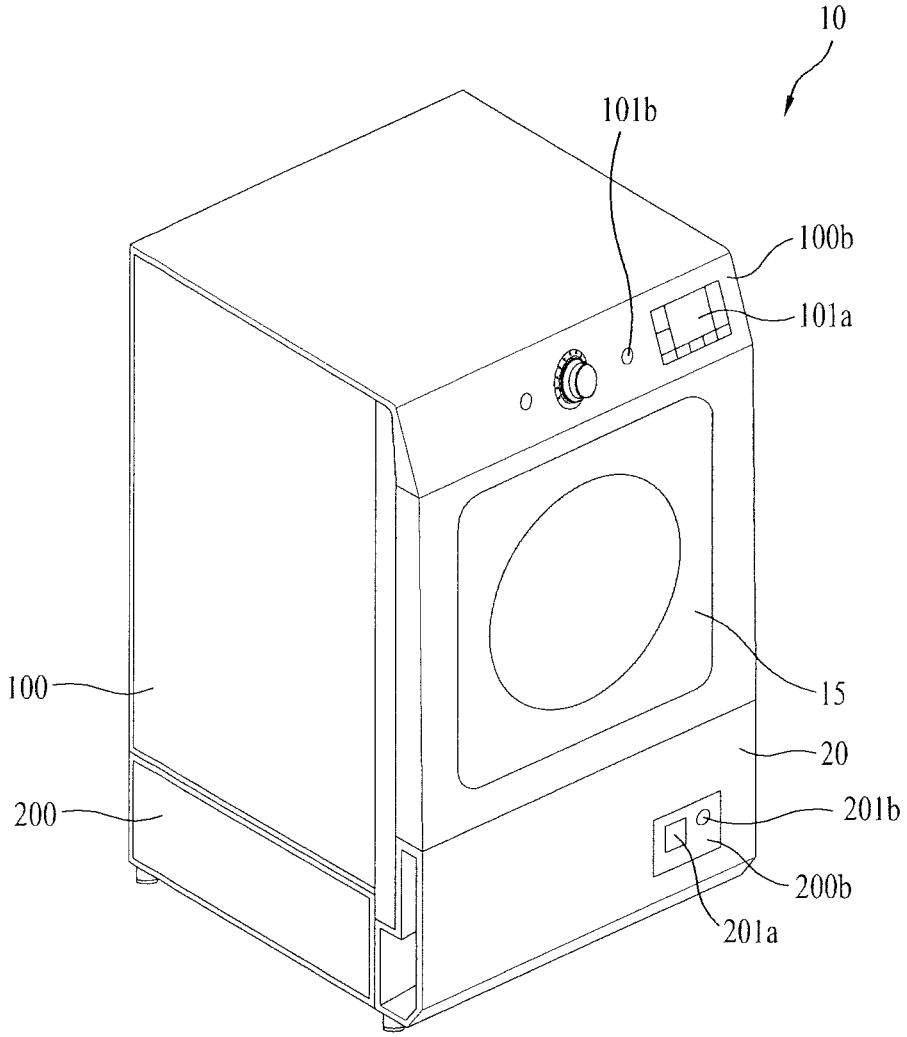
FIG. 1 is a front perspective view of a laundry treatment device according to an embodiment.
Figure 2:
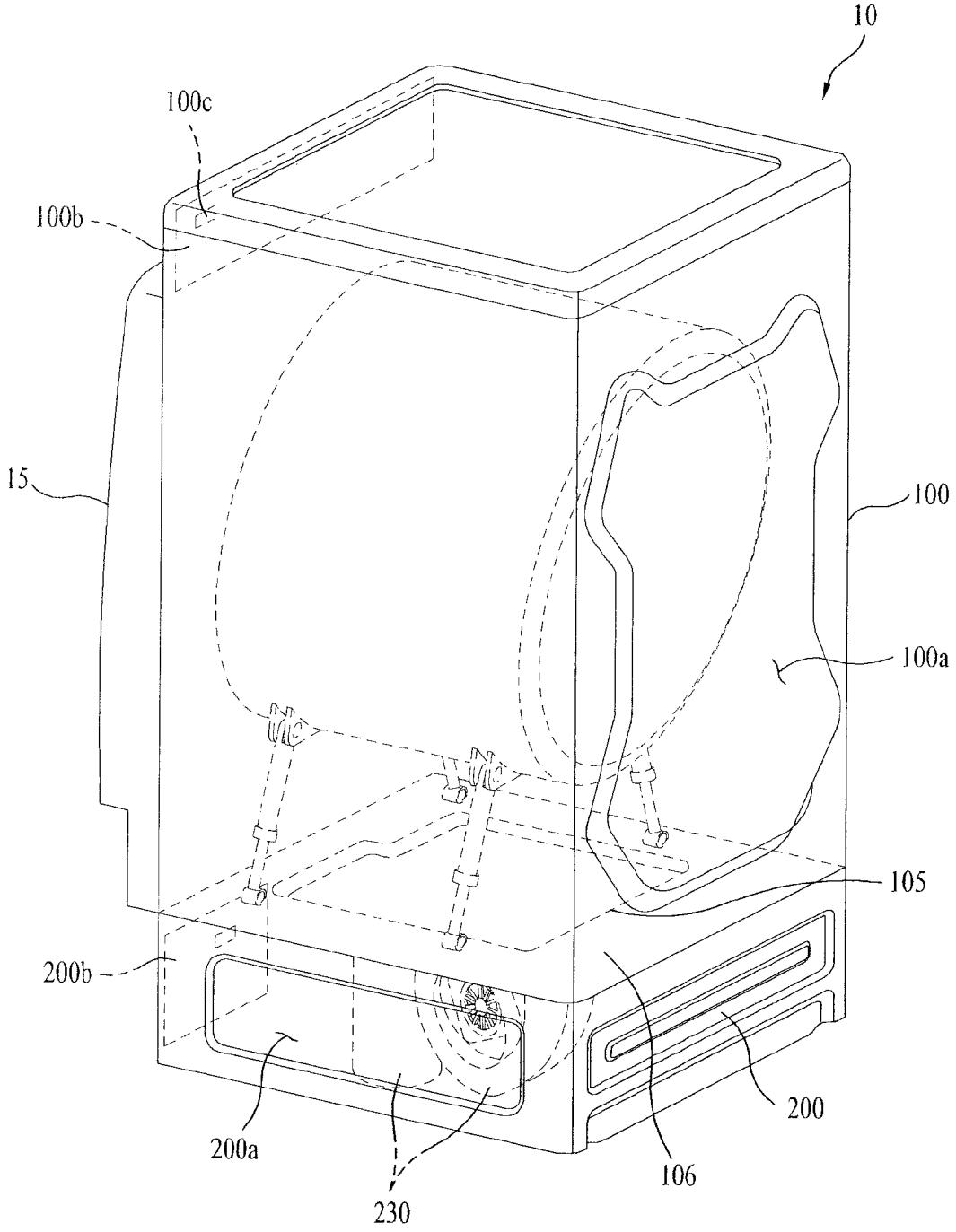
FIG. 2 is a rear perspective view of the laundry treatment device of FIG. 1.
Figure 3:
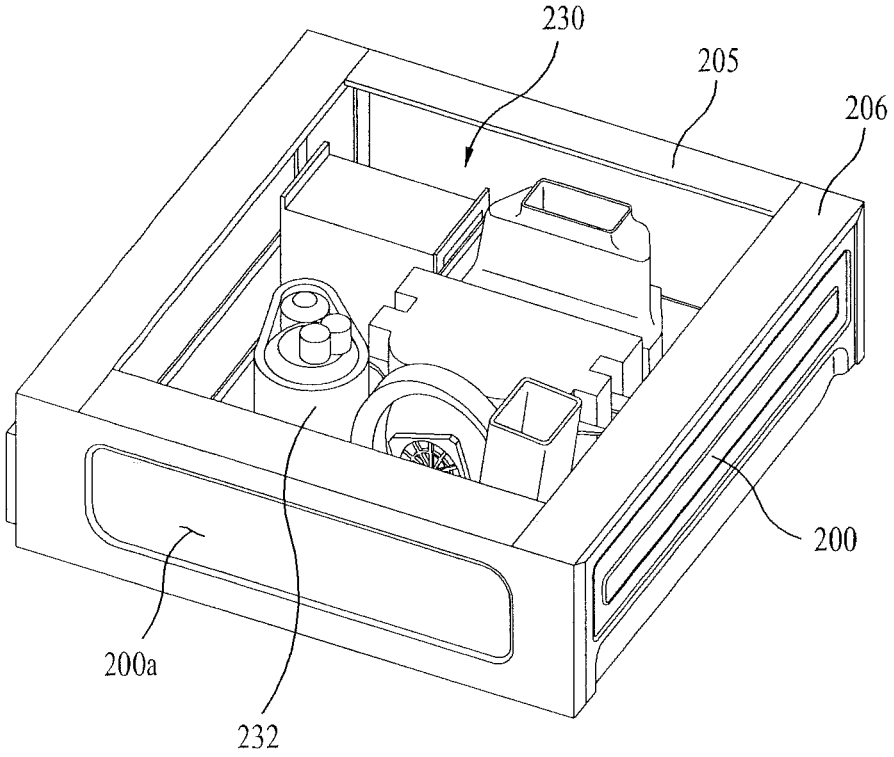
FIG. 3 is a side perspective view of a second cabinet of the laundry treatment device of FIG. 1.
Figure 4:
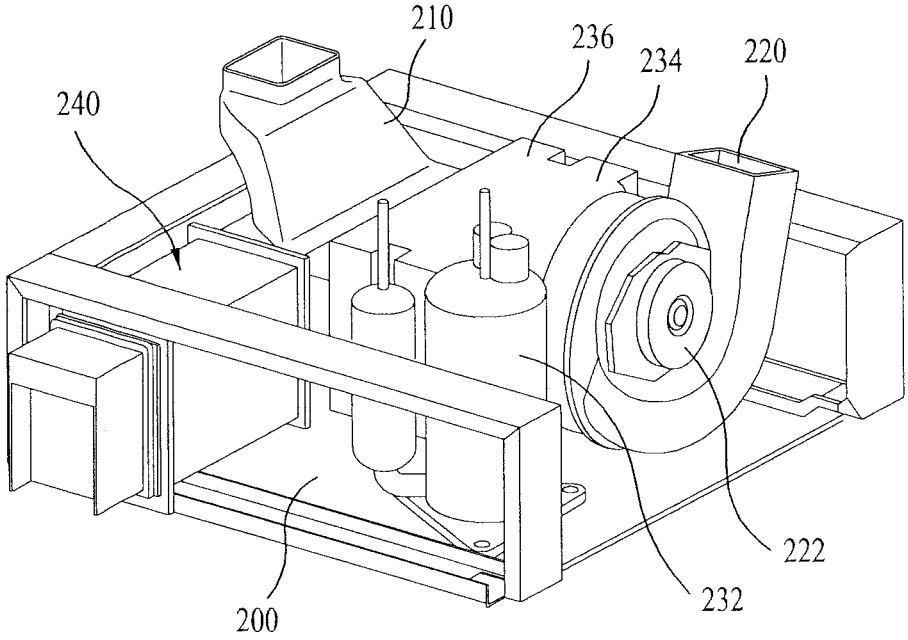
FIG. 4 is a front perspective view of the second cabinet of FIG. 3.
Figure 5:
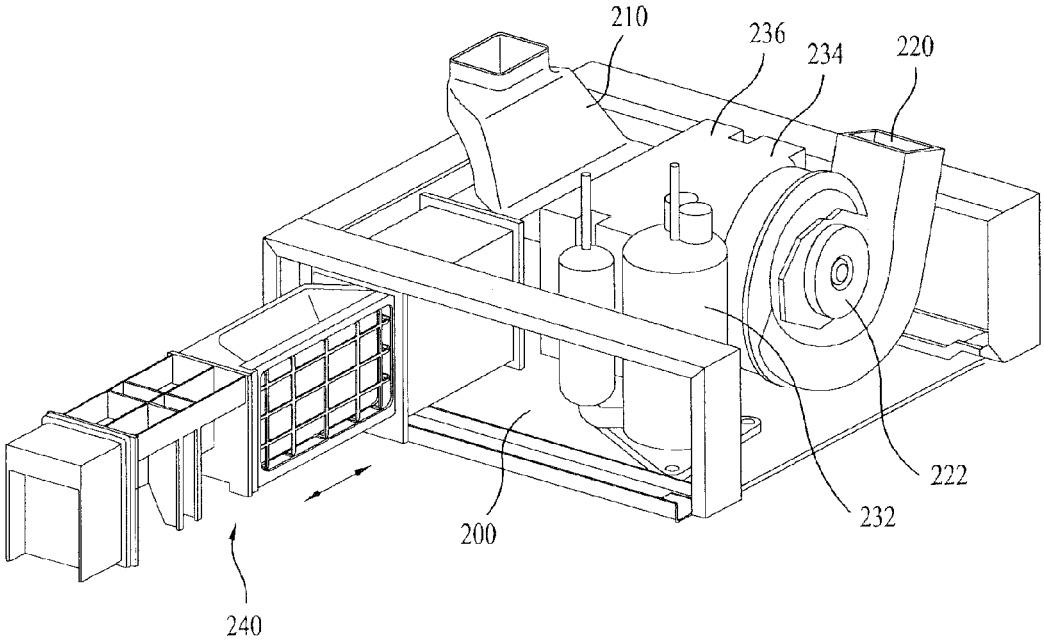
FIG. 5 is an exploded perspective view of the second cabinet of FIG. 3, showing a filter module drawn out of the second cabinet.
Figure 6:
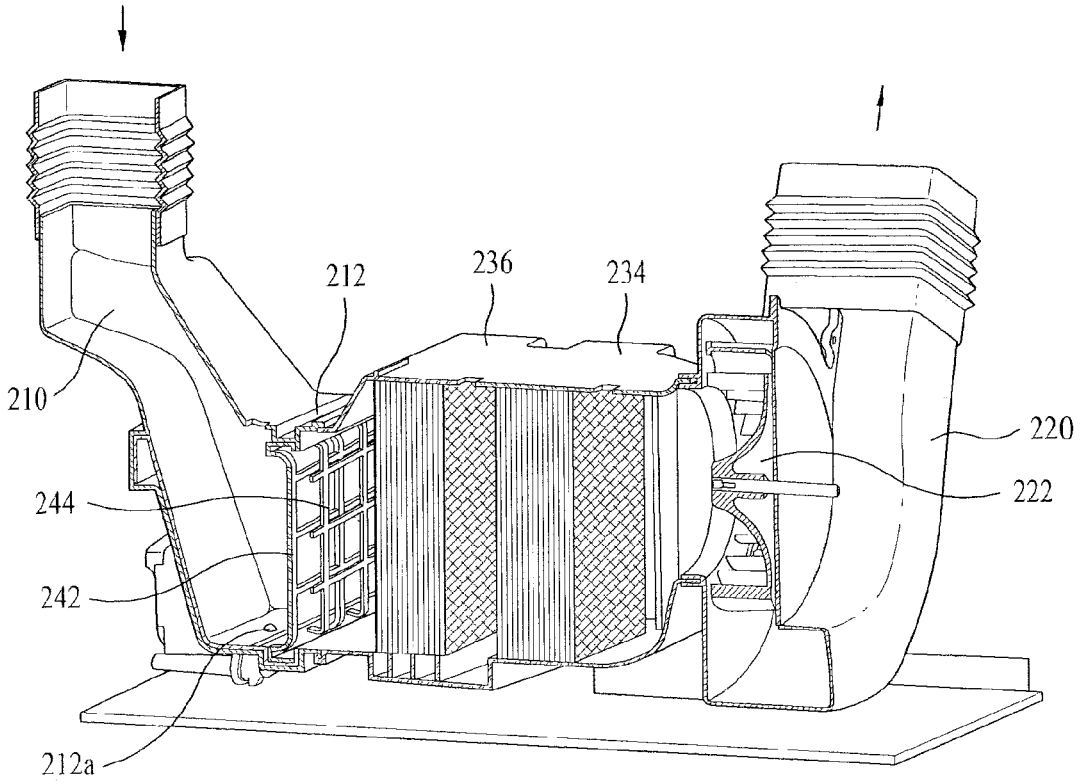
FIG. 6 is a partial perspective view showing an air flow with reference to a filter module of the laundry treatment device of FIG. 1.
Figure 7:
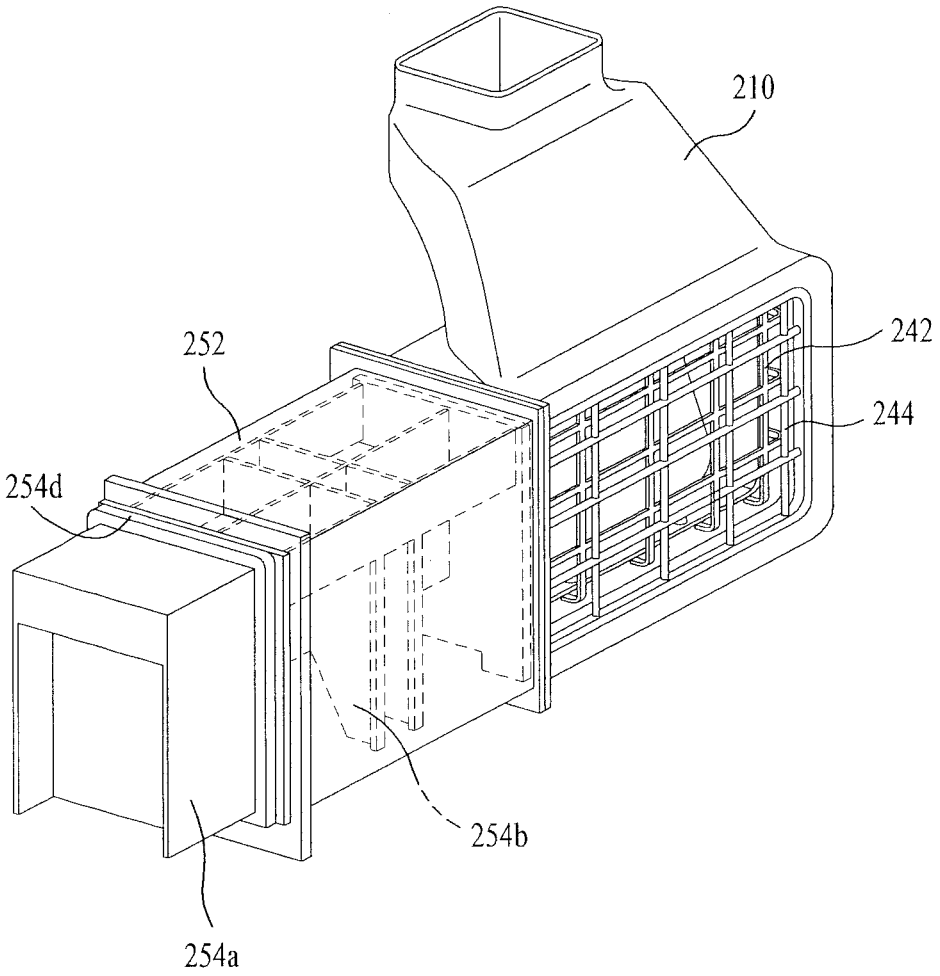
FIG. 7 is a perspective view of a filter module of the laundry treatment device of FIG. 1 assembled together.
Figure 8:
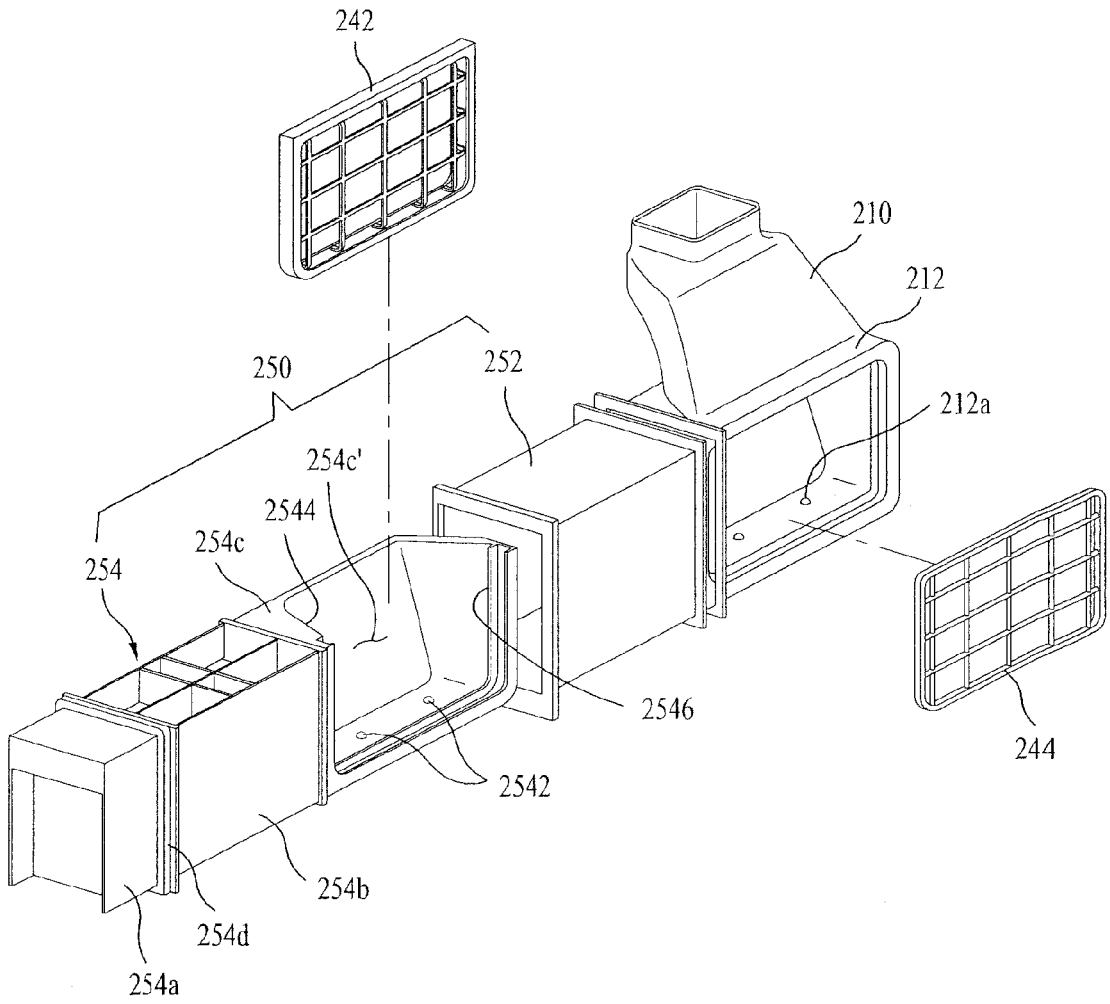
FIG. 8 is an exploded perspective view of the filter module of FIG. 7.
Figure 9:
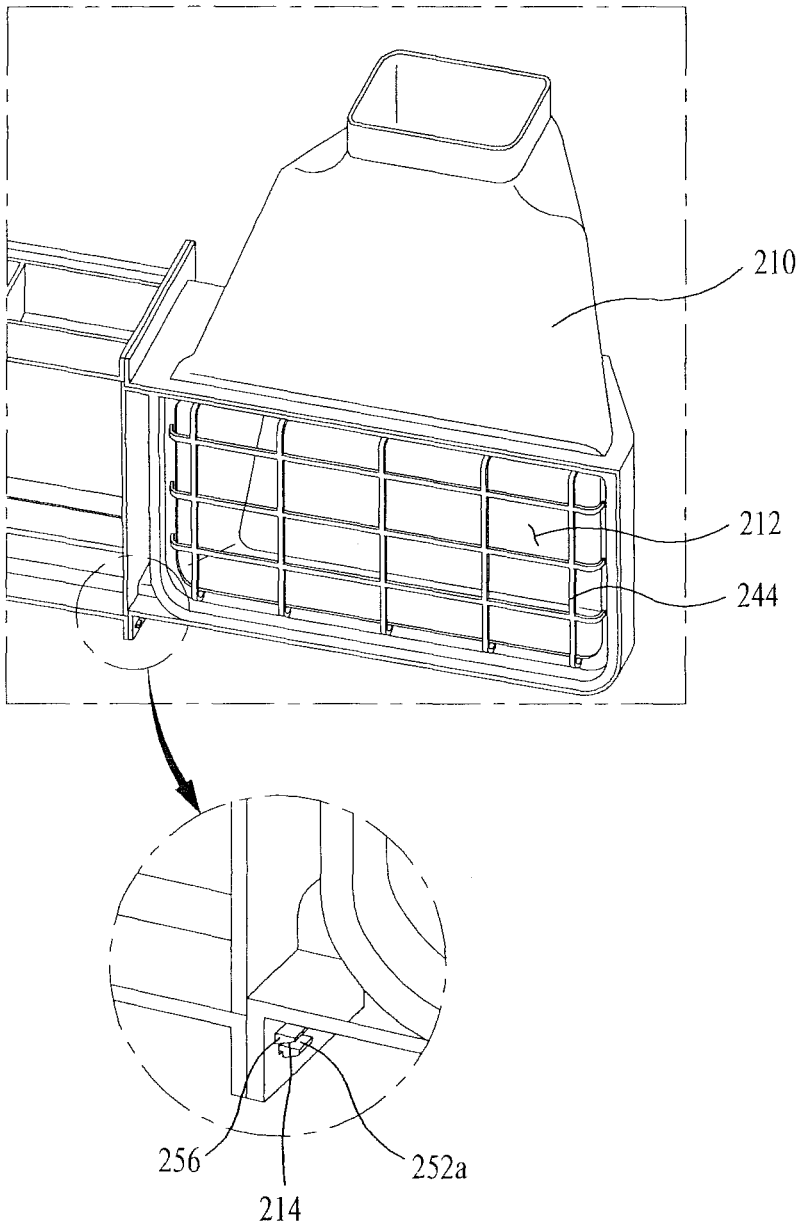
FIG. 9 is a partial perspective view showing a fastening portion of the filter module of FIG. 6.

FIG. 1 is a front perspective view of a laundry treatment device according to an embodiment. FIG. 2 is a rear perspective view of the laundry treatment device of FIG. 1. FIG. 3 is a side perspective view of a second cabinet of the laundry treatment device of FIG. 1. FIG. 4 is a front perspective view of the second cabinet of FIG. 3. FIG. 5 is an exploded perspective view of the second cabinet of FIG. 3, showing a filter module drawn out of the second cabinet. FIG. 6 is a partial perspective view showing an air flow with reference to a filter module of the laundry treatment device of FIG. 1. FIG. 7 is a perspective view of a filter module of the laundry treatment device of FIG. 1 assembled together. FIG. 8 is an exploded perspective view of the filter module of FIG. 7. FIG. 9 is a partial perspective view showing a fastening portion of the filter module of FIG. 7.

Referring to FIGS. 1 to 5, the laundry treatment device 10 may include a cabinet which forms an exterior of the laundry treatment device and various kinds of electric components mounted inside of the cabinet. The cabinet may include a first cabinet 100 which forms a main or first space 100*a* therein, a door 15 that opens/closes an opening in a front of the first cabinet 100, a tub 120 mounted in the first cabinet 100 that accommodates washing water therein, a drum (not shown) rotatably mounted in the tub 120 that receives laundry therein, and a second cabinet 200 disposed under the first cabinet 100 to form a second space 200*a*.

The first and second cabinets 100 and 200 may be formed as separate cabinets, which may then be joined together. Providing the first and second cabinets 100 and 200 as separate cabinets, which may then be joined together, allows the first cabinet 100, which is configured for laundry treatment, and the second cabinet 200, which may include a heated-dry-air supply device, to be manufactured separately and assembled at the manufacturing plant or at a later point. For example, the first and second cabinets 100 and 200 may be manufactured or assembled separately and then shipped to another destination for assembly. Further, a user or customer may not desire a laundry treatment device including the second cabinet 200 and/or the heated-dry-air supply device, and thus, may elect to purchase only the first cabinet 100, which is configured for laundry treatment. Further, if the first and second cabinets 100 and 200 are separable, they may be separated for maintenance on one or the other.

Alternatively, the first and second cabinets 100 and 200 may be integrally formed or formed as a single cabinet. In such a case, the single cabinet may be divided into first and second cabinets 100 and 200 by a dividing plate or partition wall, fully or partially separating the single cabinet into main and auxiliary spaces.

The second cabinet 200 may include an opening 205 in an upper wall 206 thereof. The first cabinet 100 may include an opening 105 in a lower wall 106 thereof. Portions of a heated-dry-air supply device, which may be in the form of a heat pump module 230 and which may be disposed in the second cabinet 200, may extend through the openings 105, 205 into the main or inner space 110 of the first cabinet 100.

The first cabinet 100 and the second cabinet 200 may have a main control panel 100*b* and a sub-control panel 200*b*, respectively, with various kinds of functional buttons mounted thereto to control the laundry treatment device 10. The sub-control panel 200*b* may be provided to control a heat pump module 230 discussed hereinbelow. However, the sub-control panel 200*b* may be omitted.

The heat pump module 230, which may supply heated dry air to dry laundry may be mounted in an auxiliary or second space 200*a* of the second cabinet 200. An inlet duct 210 may be provided that guides the air to the heat pump module 230 and an outlet duct 220 may be provided that introduces the heated dry air from the heat pump module 230 to the tub 120. The heat pump module 230 may further include a filter module 240 that filters the air introduced to the inlet duct 210. The inlet duct 210 and the outlet duct 220 may be in communication with the tub via a circulation duct (not shown) and a drying duct (not shown).

The heat pump module 230, which may comprise elements of a heat pump detachably constructed as a module, may be detachably mounted in the second cabinet 200. If the second cabinet 200 is completely separable from the first cabinet 100, the heat pump module 230 may be positioned in the second space 200*a*. Also, the inlet duct 210 and the outlet duct 220 may be connected to the first cabinet 100 by means of an additional connection structure. If the second cabinet 200 is in communication with the first cabinet 100 partially or fully, the heat pump module 230 may be positioned in the second space 200*a* or partially in the first space 100*a* and the second space 200*a*.

A filtering structure of the heat pump module in the laundry treatment device according to an embodiment that filters lint formed in a drying process of drying an object will be described hereinbelow. The filtering structure according to an embodiment may be positioned at a rear portion of the laundry treatment device, for example, at a rear portion of the second cabinet 200, but may be accessible through a front portion of the laundry treatment device, as discussed hereinbelow.

Referring to FIG. 6, the inlet duct 210 may have an 'L' shape with an opening formed in one lower side that may receive a portion of the filter module 240 therein and an air outlet 212 adjacent to an evaporator 236 that discharges the air. The air outlet 212 may have a second filter 244 of the filter module 240 to be described later coupled thereto, and a filter sliding member 254 of the filter module 240 to be described later may be placed in the opening.

Referring to FIGS. 7 to 9, the filter module 240 may include a filter member that filters foreign matter (things introduced thereto through the inlet duct, such as lint), and a filter guide member 250 that detachably supports the filter member.

The filter member may include a first filter 242 that filters foreign matter, such as lint, introduced thereto through the inlet duct 210, and a second filter 244 that filters particles relatively smaller than the first filter 242. The first filter 242 may be slidably and detachably coupled to the filter guiding member 250, and the second filter 244 may be coupled to the air outlet 212 in the inlet duct 210 by, for example, bolts. The first filter 242 may be detachably coupled so that the user may draw out the first filter 242, separate from filter guiding member 250, and clean the first filter 242. The second filter 244 may be exposed when the second cabinet 200 is drawn out for maintenance or replacement of components for cleaning.

The filter guiding member 250 may include a supporting member 252 coupled to the one side opening in the inlet duct 210, a filter sliding member 254 having one end disposed in the supporting member 252 so as to be placed in a lower side of the inlet duct 210 and the other end exposed from the second cabinet 200.

The supporting member 252 may have a box shape with opposite openings in placing in/drawing out directions of the filter sliding member 254. The supporting member 252 may be fastened to the opening in the inlet duct 210 with fastening means, such as bolts or hooks. The supporting member 252 may house and support the filter sliding member 254. In embodiments disclosed herein, an example is shown, in which a fastening hook 252*a* is formed at one side of the supporting member 252 and a hook hole 214 is formed in an opening side of the inlet duct 210, which may be fastened together (See FIG. 9).

The filter sliding member 254 may include a hand holding or grip portion 254*a* exposed to outside of the second cabinet 200, a connection portion 254*b*, which may be formed as one body with the hand grip portion 254*a*, and a filter supporting portion 254*c*, which may be formed as one body with the connection portion 254*b*, configured to couple the first filter 242 thereto. A sealing member 254*d* may be mounted between the hand grip portion 254*a* and the connection portion 254*b* to seal a space between the hand grip portion 254*a* and the supporting portion 252 in a state in which the filter guiding member 250 is mounted to the heat pump module 230.

The hand grip portion 254*a* may be exposed at a front of the second cabinet 200 so that the user may pull the hand grip portion 254*a*. When the hand grip portion 254*a* is pulled, the filter sliding member 254 and the first filter 242 are exposed from the second cabinet 200. Since the filter sliding member 254 may be drawn out of the cabinet 200, the user may clean the first filter 242 and a receiving space 254*c*' which will be described later.

The connection portion 254*b* may have a length equal to a length of the supporting member 252. Since the inlet duct 210 may be in a rear of the second cabinet 200, if the filter sliding member 254 having the first filter 242 coupled thereto enters up to the inlet duct 210, it may be required that the filter guiding member 250 has an adequate length. Therefore, the connection portion 254*b* may have a length enough to place the filter guiding member 250 in the inlet duct 210.

In order to form a dual filter structure with the first filter 242 facing the second filter 244 in a state in which the filter guiding member 250 is mounted to the filter supporting portion 254*c*, the first filter 242 is mounted to a side of the filter supporting portion 254*c*. The filter supporting portion 254*c* supports the first filter 242, such that the first filter 242 is slidably mounted to the filter supporting portion 254*c* in an up/down direction. The filter supporting portion 254*c* fauns a receiving space 254*c*' having an open top that may receive foreign matter that drops down from the inlet duct 210. The receiving space 254*c*' may have a 'U' shape substantially at an inlet portion 2544 and an outlet portion 2546 having a shape corresponding to a shape of a lower side of the inlet duct 210. That is, if the inlet portion 2544 and the outlet portion 2546 have shapes corresponding to the shape of the lower side of the inlet duct 210, the foreign matter receiving space 254*c*' of the filter supporting portion 254*c* is positioned at a low end of an inside of the inlet duct 210 in a state in which the filter guiding member 250 is mounted. Accordingly, the foreign matter, such as lint, may be captured in the receiving space 254*c*'. Moreover, the foreign matter that falls from the first filter 242 may also be captured in the receiving space 254*c*', thereby preventing the foreign matter from escaping to an outside of the heat pump module 230.

The filter supporting portion 254*c* may be closely fastened to the inlet duct 210 to prevent the foreign matter from escaping through a gap between the air outlet 212 of the inlet duct 210 and an open portion of the receiving space 254*c*'. For this purpose, the filter supporting portion 254*c* may have a plurality of holding recesses 2542 in an underside thereof at positions matched to, and corresponding to, holding projections 212*a* on a bottom surface of an inside of the inlet duct 210.

As the holding projections 212*a* are held at the holding recesses 2542 respectively in a state in which the filter guiding member 250 is mounted to the heat pump module 230, the filter guiding member 250 may be secured for the first time, and as the fastening hook 252*a* on the supporting member 252 is placed in the hook hole 214 in one side of the inlet duct 210, the filter guiding member 250 is secured for the second time.

The sealing member 254*d* may be positioned between the hand holding portion 254*a* and the connection portion 254*b* to provide a seal between the filter sliding member 254 and the supporting member 252 in a state in which the filter sliding member 254 is placed in the supporting member 252. The sealing member 254*d* may also serve to seal between the filter module 240 and the second cabinet 200 such that no foreign matter infiltrates through a coupled portion of the filter module 240 and the second cabinet 200 in a state in which the filter module 240 is mounted to the heat pump module 230.

The laundry treatment device according to embodiments disclosed herein may include a sensor 256 that senses proper mounting of the filter module 240 at a proper position. The sensor 256, which may be mounted to an inside of the inlet duct 210, may sense a mounting state of the filter guiding member 250 by being brought into contact with the filter module 240 if the filter guiding member 250 is mounted.

Or, the sensor 256 may be mounted at a particular position of the filter guiding member 250, so that the sensor 256 may sense a mounting position of the filter module 240 by sensing the filter guiding member 250 at a specific position in the inlet duct 210.

If the sensor 256 senses mounting or a mounting error of the filter module 240, a sensing signal may inform the user through a display device 101*a* or a voice output device 101*b* of the main control panel 101*b* on the first cabinet 100, or through a display 201*a* or a voice output device 201*b* of the sub-control panel 200*b* which may be formed on the second cabinet 200.

According to this, the user may determine whether the filter module 240 is mounted at a proper position at the time the filter module 240 is re-mounted after cleaning by information from the voice output device 100*c* or 200*c* or the display.

Embodiments disclosed herein are directed to a heat pump module and a laundry treatment device utilizing the same. Embodiments disclosed herein provide a heat pump module and a laundry treatment device utilizing the same having a dual filter structure which may prevent heat transfer efficiency of a heat pump module from becoming poor or being reduced due to the introduction of lint into an inlet duct.

Embodiments disclosed herein provide a laundry treatment device, which may include a cabinet that forms an exterior of the clothes treating device, a tub mounted in the cabinet configured to accommodate washing water, a drum rotatably mounted in the tub configured to receive laundry therein, a heat pump module mounted under the tub that supplies heated dry air to the drum and having an inlet duct that receives air from the drum and an outlet duct that discharges the heated dry air, and a filter module mounted to be accessible through a lower side of a front of the cabinet that filters air received through the inlet duct.

The filter module may include a filter member that filters foreign matters, and a filter guiding member that detachably supports the filter member. The filter member may include a first filter that filters lint produced from the laundry and foreign matters, and a second filter that filters particles relatively smaller than the first filter. The filter guiding member may include a supporting member coupled to the inlet duct, and a filter sliding member placed in the supporting member so as to be detachably coupled to an inside of a lower side of the inlet duct with one end exposed from the second cabinet.

The inlet duct may have a receiving space having one lower side opening that receives the filter sliding member therein. The filter sliding member may include a hand holding portion exposed from the second cabinet, a connection portion formed as one body with the hand holding portion having a length equal to a length of the supporting member, and a filter supporting portion formed as one body with the connection portion that detachably couples the first filter thereto. The filter sliding member may further include a sealing member mounted between the hand holding portion and the connection portion that provides a seal between the hand holding portion and the supporting portion in a state in which the filter guiding member is mounted to the heat pump module.

The second filter may be mounted to an air outlet side of the inlet duct. The first filter may be slidably mounted to a side of the filter supporting portion facing the second filter in a state in which the filter guiding member is mounted.

The filter supporting portion may have a receiving space that receives foreign matters that fall down from the inlet duct. The receiving space may have an inlet portion and an outlet portion with shapes corresponding to a shape of a lower side of the inlet duct. The filter supporting portion may be closely fastened to the inlet duct, such that no foreign matter may escape through a gap to an open portion of the inlet duct.

The supporting member may include at least one fastening hook to be placed in one side of the inlet duct, and the inlet duct may include a hook hole in one side for placing in the fastening hook therein. The inlet duct may further include at least one holding projection having a predetermined elasticity that projects from an inside bottom surface thereof, and the connection portion may further include a holding recess that holds the holding projection in a state in which the filter supporting portion is placed in the inlet duct.

The filter guiding member may further include a sensor that senses whether the filter supporting portion is coupled to a coupling position at an inside of the inlet duct. Whether the filter supporting portion is coupled to a coupling position at an inside of the inlet duct may be displayed on a control panel or announced with an alarm. The control panel may be a main control panel on the first cabinet or a sub-control panel additionally provided with the second cabinet. The alarm may be provided from a voice output device provided with the main control panel or the sub-control panel.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment device, comprising:

a cabinet that forms an exterior of the laundry treatment device;

a tub mounted in the cabinet that accommodates washing water therein;

a drum rotatably mounted in the tub configured to receive laundry therein;

a heat pump module mounted under the tub that supplies heated air to the drum, the heat pump module having an inlet duct configured to receive air from the drum, and an outlet duct configured to discharge the heated air; and a filter module mounted to be accessible through a front of the cabinet that filters air, wherein the filter module includes a receiving space configured to receive foreign matter that falls down from the inlet duct, wherein the filter module further includes a first filter that filters foreign matter, and a filter guide member that detachably supports the first filter, wherein the filter guide member includes a supporting member coupled to the inlet duct, and a filter sliding member disposed in the supporting member so as to be detachably coupled to an inside of a lower side of the inlet duct with one end exposed from the cabinet, wherein the inlet duct is in the shape of an 'L', and wherein a portion of the filter module is received in a lower portion of the 'L'-shaped inlet duct such that the first filter is substantially vertically oriented therein.

2. The laundry treatment device as claimed in claim 1, wherein the receiving space includes an inlet portion and an outlet portion having shapes corresponding to a shape of a lower side of the inlet duct.

3. The laundry treatment device as claimed in claim 1, wherein the first filter filters lint produced from the laundry and foreign matter and the laundry treatment device further comprises a second filter that filters particles relatively smaller than that filtered by the first filter.

4. The laundry treatment device as claimed in claim 1, wherein the inlet duct includes a receiving space having one lower side opening configured to receive the filter sliding member therein.

5. The laundry treatment device as claimed in claim 3, wherein the filter sliding member includes:

a hand grip portion exposed outside of the cabinet;

a connection portion attached to the hand grip portion; and a filter supporting portion attached to the connection portion and configured to receive the first filter detachably coupled thereto.

6. The laundry treatment device, as claimed in claim 5, wherein the hand grip portion, the connection portion, and the filter supporting portion are formed as one body.

7. The laundry treatment device as claimed in claim 5, wherein the connection portion has a length corresponding to a length of the supporting member.

8. The laundry treatment device as claimed in claim 5, wherein the filter sliding member further includes:

a sealing member provided between the hand grip portion and the connection portion to seal a space between the hand grip portion and the supporting portion in a state in which the filter guiding member is mounted to the heat pump module.

9. The laundry treatment device as claimed in claim 5, wherein the second filter is mounted to an air outlet side of the inlet duct.

10. The laundry treatment device as claimed in claim 9, wherein the first filter is slidably mounted to a side of the filter supporting portion facing the second filter in a state in which the filter guiding member is mounted to the heat pump module.

11. The laundry treatment device as claimed in claim 5, wherein the filter supporting portion comprises the receiving space configured to receive foreign matter that falls down from the inlet duct.

12. The laundry treatment device as claimed in claim 11, wherein the receiving space includes an inlet portion and an outlet portion having shapes corresponding to a shape of a lower side of the inlet duct.

13. The laundry treatment device as claimed in claim 12, wherein the filter supporting portion is closely fastened to the inlet duct, such that no foreign matter escapes through a gap to an open portion of the inlet duct.

14. The laundry treatment device as claimed in claim 12, wherein the supporting member includes at least one fastening hook, and wherein the inlet duct includes at least one hook hole configured to receive the corresponding at least one fastening hook therein.

15. The laundry treatment device as claimed in claim 12, wherein the inlet duct includes at least one holding projection having a predetermined elasticity that projects from an inside bottom surface thereof, and wherein the connection portion includes at least one holding recess configured to hold the at least one holding projection in a state in which the filter supporting portion is placed in the inlet duct.

16. The laundry treatment device as claimed in claim 5, wherein the filter guide member further includes a sensor that senses whether the filter supporting portion is coupled to a coupling position at an inside of the inlet duct.

17. The laundry treatment device as claimed in claim 16, wherein the coupling of the filter supporting portion to the coupling position at the inside of the inlet duct is displayed on a control panel or announced with an alarm.

18. The laundry treatment device as claimed in claim 17, wherein the cabinet comprises a first cabinet and a second cabinet and wherein the control panel comprises at least one of a main control panel provided on the first cabinet or a subcontrol panel provided on the second cabinet.

19. The laundry treatment device as claimed in claim 18, wherein the alarm is provided from a voice output device provided on the main control panel or the subcontrol panel.

20. The laundry treatment device as claimed in claim 1, wherein the cabinet comprises a first cabinet and a second cabinet.

21. The laundry treatment device as claimed in claim 20, wherein the tub and the drum are mounted in the first cabinet and the heat pump module and the filter module are mounted in the second cabinet.

22. The laundry treatment device as claimed in claim 21, wherein the second cabinet is detachably coupled to the first cabinet.

23. The laundry treatment device as claimed in claim 21, wherein the second cabinet is disposed below the first cabinet.

24. The laundry treatment device as claimed in claim 21, wherein the second cabinet is in the form of a drawer.

25. The laundry treatment device as claimed in claim 1, wherein the filter module filters the air received through the inlet duct to capture the foreign matter, and wherein the filter module is disposed at a rear portion of the laundry treatment device, but is accessible by a user from a front portion of the laundry treatment device.

26. The laundry treatment device as claimed in claim 1, wherein the filter module filters the air received through the inlet duct to capture the foreign matter, and wherein the filter module is slidably accessible from a front portion of the laundry treatment device.

27. The laundry treatment device as claimed in claim 1, wherein the first filter is slidably attached to the filter guide member so as to be substantially vertically oriented.

28. The laundry treatment device as claimed in claim 1, wherein the inlet duct includes an air inlet and an air outlet, wherein a second filter is mounted in the air outlet, and wherein when a portion of the filter module is mounted in the inlet duct, the first and second filters are substantially vertically oriented so as to be substantially parallel to one another.

29. The laundry treatment device as claimed in claim 1, wherein the supporting member is in the form of an elongated box with open ends.

30. The laundry treatment device as claimed in claim 1, wherein the receiving space is 'U'-shaped with an open top, and wherein the receiving space is configured to receive the first filter slidably mounted therein in a substantially vertical direction adjacent an outlet portion of the receiving space.

31. A laundry treatment device, comprising:

a cabinet that forms an exterior of the laundry treatment device;

a tub mounted in the cabinet that accommodates washing water r therein;

a drum rotatably mounted in the tub configured to receive laundry therein;

a heat pump module mounted under the tub that supplies heated air to the drum, the heat pump module having an inlet duct configured to receive air from the drum, and an outlet duct configured to discharge the heated air; and a filter module mounted to be accessible through a lower side of a front of the cabinet that filters air, wherein the filter module includes a receiving space configured to receive foreign matter that falls down from the inlet duct, wherein the filter module further includes a filter member that filters foreign matter, and a filter guide member that detachably supports the filter member, wherein the filter guide member includes a supporting member coupled to the inlet duct, and a filter sliding member disposed in the supporting member so as to be detachably coupled to an inside of a lower side of the inlet duct with one end exposed from the cabinet, wherein the inlet duct is in the shape of an 'L', and wherein a portion of the filter module is received in a lower portion of the 'L'-shaped inlet duct such that the filter member is substantially vertically oriented therein.

* * * * *